US007015772B2

(12) United States Patent
Ji

(10) Patent No.: US 7,015,772 B2
(45) Date of Patent: Mar. 21, 2006

(54) TUNABLE AMPLITUDE UNBALANCE STRIPLINE COMBINER

(75) Inventor: Daxiong Ji, Brooklyn, NY (US)

(73) Assignee: Scientific Components Corporation, Brooklyn, NY (US)

( * ) Notice: Subject to any disclaimer, the term of this patent is extended or adjusted under 35 U.S.C. 154(b) by 88 days.

(21) Appl. No.: 10/788,740

(22) Filed: Mar. 1, 2004

(65) Prior Publication Data

US 2005/0190012 A1 Sep. 1, 2005

(51) Int. Cl.
*H01P 5/12* (2006.01)

(52) U.S. Cl. ..... 333/128; 333/125; 333/136

(58) Field of Classification Search ..... 333/246, 333/238, 100, 124, 125, 127, 128, 136
See application file for complete search history.

(56) References Cited

U.S. PATENT DOCUMENTS 3,815,055 A * 6/1974 Plunk et al. ..... 333/128
5,001,492 A * 3/1991 Shapiro et al. ..... 343/700 MS
5,021,755 A * 6/1991 Gustafson ..... 333/128
5,909,155 A * 6/1999 Anderson et al. ..... 333/100
6,624,729 B1 * 9/2003 Wright et al. ..... 333/238
6,790,049 B1 * 9/2004 Kaylie et al. ..... 439/76.1

* cited by examiner

*Primary Examiner*—Robert J. Pascal
*Assistant Examiner*—Kimberly E. Glenn
(74) *Attorney, Agent, or Firm*—Kevin Redmond

(57) ABSTRACT

A tunable amplitude unbalance stripline combiner for RF signals in which the amplitude unbalance can be adjusted in order to minimize the amplitude unbalance.

The combiner has an upper printed circuit board mounted over a lower printed circuit board. The lower printed circuit board has a pair of printed circuit lines that are connected between an output port and a pair of input ports. The upper printed circuit board has a metallized area covering the top surface. Several non-metallized cavities are located in the metallized area above the circuit lines. The number of cavities can be adjusted to change the amplitude unbalance.

20 Claims, 10 Drawing Sheets

TUNABLE AMPLITUDE UNBALANCE STRIPLINE COMBINER

BACKGROUND

1. Field of the Invention

This invention relates to power combiners used with RF and microwave frequency signals in general and more particularly to a tunable combiner in which amplitude unbalance between the input and output ports can be minimized or eliminated.

2. Description of the Prior Art

Power combiners couple electromagnetic energy from multiple input ports to an output port. They are used in a number of applications such as combining two or more signals at the same or different frequencies for transmission by a common antenna or combining outputs of multiple power amplifiers.

Power combiners have been fabricated using printed circuit boards with stripline circuit lines. Stripline refers to a circuit line that is sandwiched between two grounded planes. The ground planes control the impedance of the circuit line. The stripline design provides low insertion loss.

Referring to FIG. 1, a conventional stripline combiner 20 is shown. Combiner 20 has an upper printed circuit board 22 mounted over a lower printed circuit board 26. Upper printed circuit board 22 has a top surface 23 and bottom surface 24. Lower printed circuit board 26 has a top surface 27, bottom surface 28 and ends 29 and 30. Top surface 23 is covered with a conductive metallized layer or area 25. Similarly, bottom surface 28 is covered with a conductive metallized layer or area 31. Metallized layers 25 and 31 serve as ground planes.

A circuit line or stripline 32 is formed on top surface 27. Circuit line 32 has ends 33 and 34. A circuit line or stripline 36 is also formed on top surface 27. Circuit line 36 has ends 37 and 38. A common line 40 is connected with ends 34 and 38. Port 42 is connected to common line 40. Port 44 is connected to circuit line end 33. Port 46 is connected to circuit line end 37. Ports 44 and 46 would be input ports and port 42 an output port. Conductive vias 48 extend from top surface 27 to bottom surface 28.

Unfortunately, etching of the circuit lines during manufacturing is uneven due to manufacturing process variables and tolerances. The uneven etching leads to the circuit lines having different line widths. The uneven line width causes impedance differences in the circuit lines and the insertion loss between the input port and output port to be different. The uneven line width also causes amplitude unbalance between the input port and output port. Amplitude unbalance degrades the electrical performance of the combiner. The amount of amplitude unbalance is an important parameter in the performance of the combiner.

While power combiners have been used, they have suffered from having a large amplitude unbalance. What is needed is a power combiner that can be tuned to provide a low amplitude unbalance over a wide range of frequencies.

SUMMARY

It is a feature of the invention to provide a combiner for RF signals in which the amplitude unbalance is minimized.

Another feature of the invention is to provide a combiner with improved electrical performance.

Another feature of the invention is to provide a combiner in which the amplitude unbalance is adjustable.

A further feature of the invention is to provide a method of manufacturing a tunable stripline combiner.

A further feature of the invention is to provide a tunable combiner that includes a case having a cavity, a top surface and a bottom surface. The cavity defines four walls and a mounting surface. A lower printed circuit board has a top surface and a bottom surface. The lower printed circuit board is mounted in the cavity on the mounting surface. A first metallized area substantially covers the bottom surface of the lower printed circuit board. The first metallized area is in electrical contact with the case. A first circuit line is located on the top surface and has one end connected to an input port and another end connected to a first output port. A second circuit line is located on the top surface and has one end connected to the input port and another end connected to a second output port. An upper printed circuit board has a top surface and a bottom surface. The second printed circuit board is mounted over the first printed circuit board in the cavity. A second metallized area substantially covers the top surface of the upper printed circuit board. A first set of non-metallized voids are located in the second metallized area juxtaposed to the first circuit line. A second set of non-metallized voids are located in the second metallized area juxtaposed to the second circuit line. A cover is mounted over the cavity and attached to the case.

It is noted that the drawings of the invention are not to scale.

DETAILED DESCRIPTION

Figure 1:
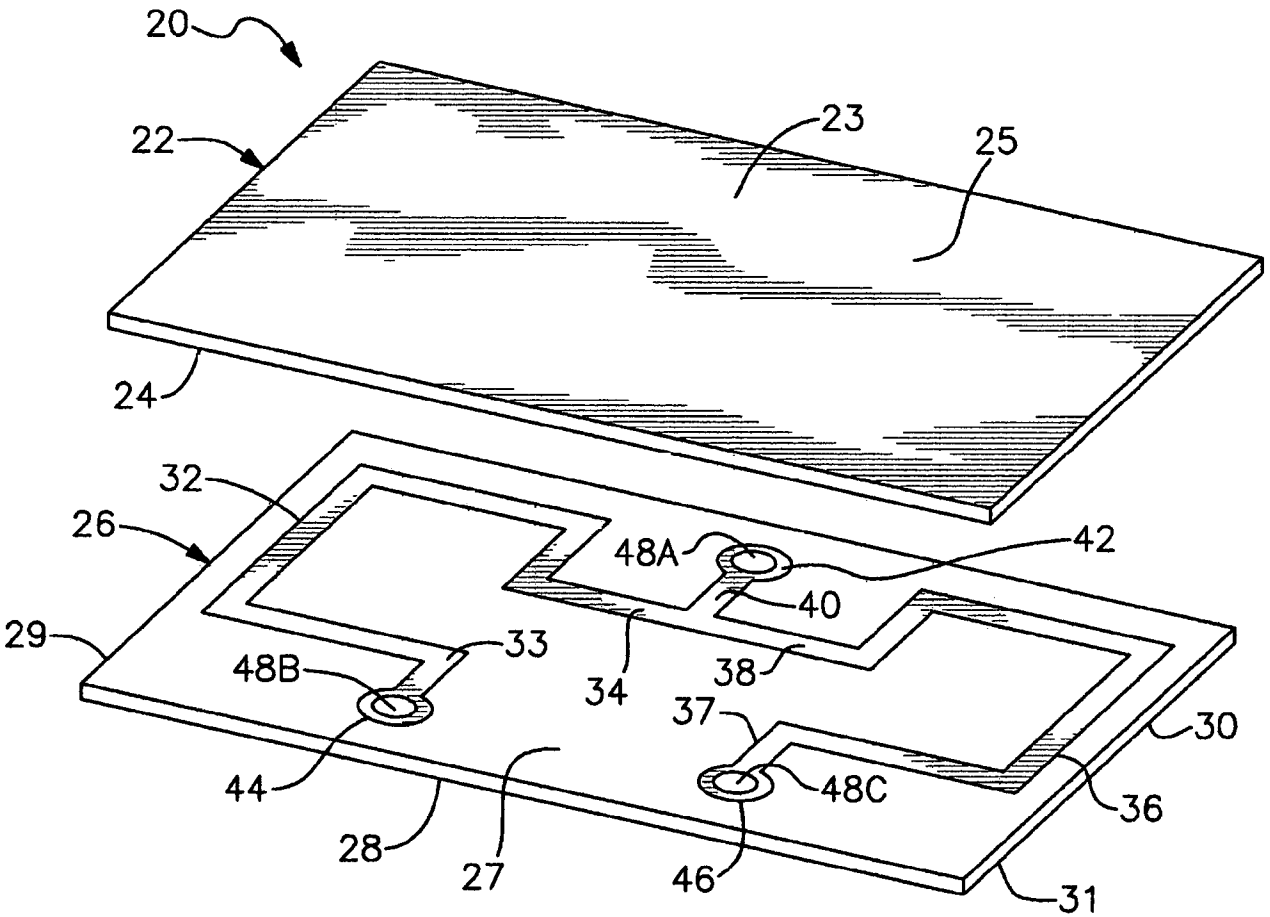
Fig. 1 (Prior Art)
FIG. 1 is an exploded view of a conventional 2-way stripline combiner.
Figure 2:
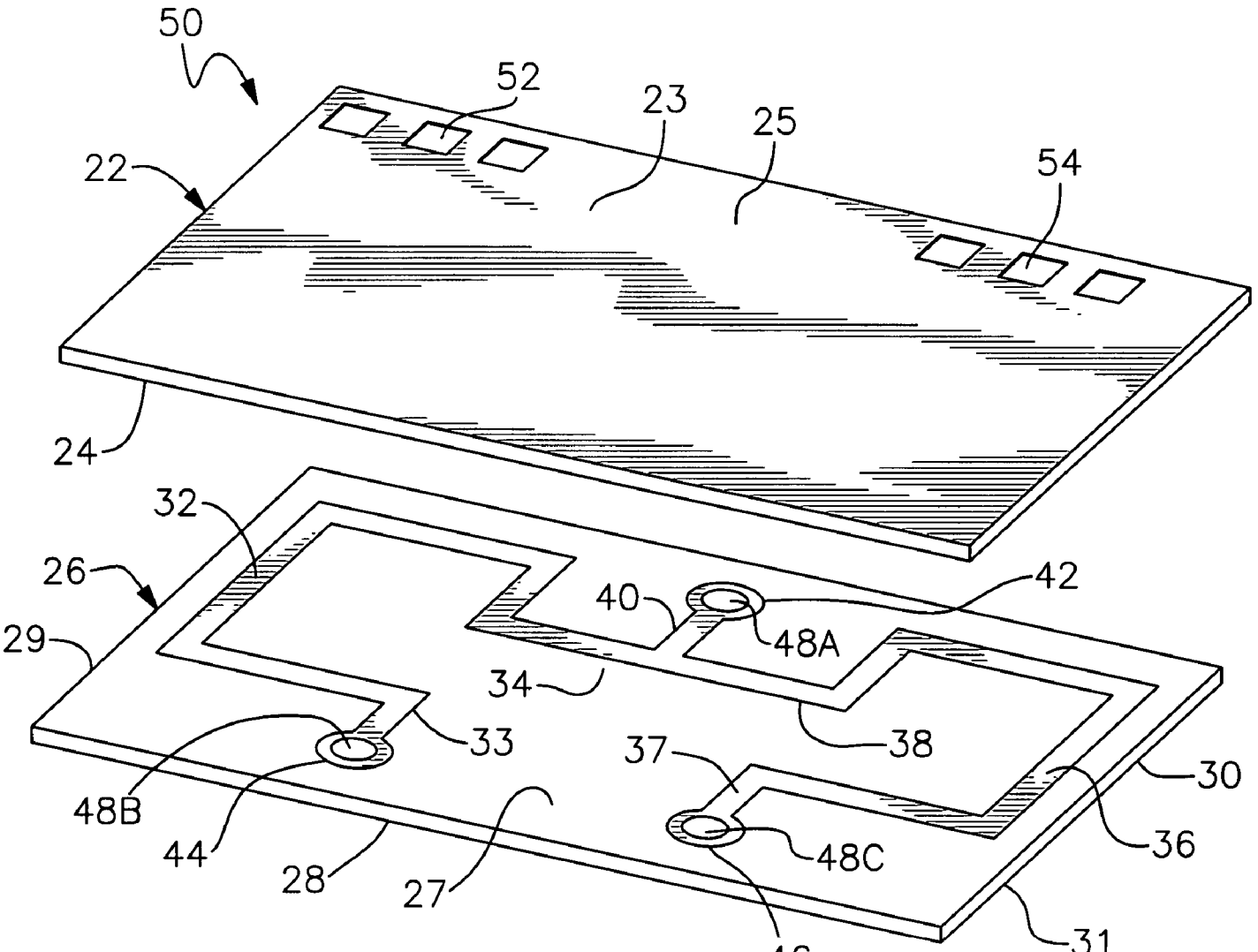
FIG. 2 is an exploded view of a Tunable Amplitude Unbalance Stripline Combiner in accordance with the present invention.

Referring to FIG. 2, a tunable amplitude unbalance stripline combiner 50 of the present invention is shown. Tunable combiner 50 has an upper printed circuit board 22 mounted over a lower printed circuit board 26. Upper printed circuit board 22 has a top surface 23 and bottom surface 24. Lower printed circuit board 26 has a top surface 27, bottom surface 28 and ends 29 and 30. Top surface 23 is covered with a conductive metallized layer or area 25. Similarly, bottom surface 28 is covered with a conductive metallized layer or area 31. The printed circuit board is conventionally made from an insulating material such as fiberglass and resin and the metallized layer is a copper foil. Metallized areas 25 and 31 serve as grounded planes.

A circuit line or stripline 32 is formed on top surface 27 toward end 29. Circuit line 32 is C-shaped. Circuit line 32 has ends 33 and 34. A circuit line or stripline 36 is also formed on top surface 27 toward end 30. Circuit line 36 is C-shaped. Circuit line 36 has ends 37 and 38. Circuit lines 32 and 36 are symmetric. A common line 40 is connected with ends 34 and 38. An S or output port 42 is connected to common line 40. An input port 44 is connected to circuit line end 33. Input port 46 is connected to circuit line end 37. Signals to be combined are placed on ports 44 and 46. The combined signal is obtained from port 42. The ports 42, 44 and 46 each have conductive vias or plated through holes 48A, 48B and 48C that extend from top surface 27 to bottom surface 28. An unmetallized area (not shown) on bottom surface 28 would surround vias 48.

Several non-metallized voids, or areas 52 and 54 are located in the metallized area 25. Non-metallized voids, or areas 52 and 54 are areas in the metallized area 25 where the metallization has been removed. Voids 52 are located above or adjacent to circuit line 32. Voids 54 are located above or adjacent to circuit line 36. While three voids are shown above each circuit line, more or fewer lines can be used depending upon how much the impedance of the circuit lines are desired to be changed. The voids 52 and 54 can be formed using a knife to peel off the copper foil.

Figure 3:
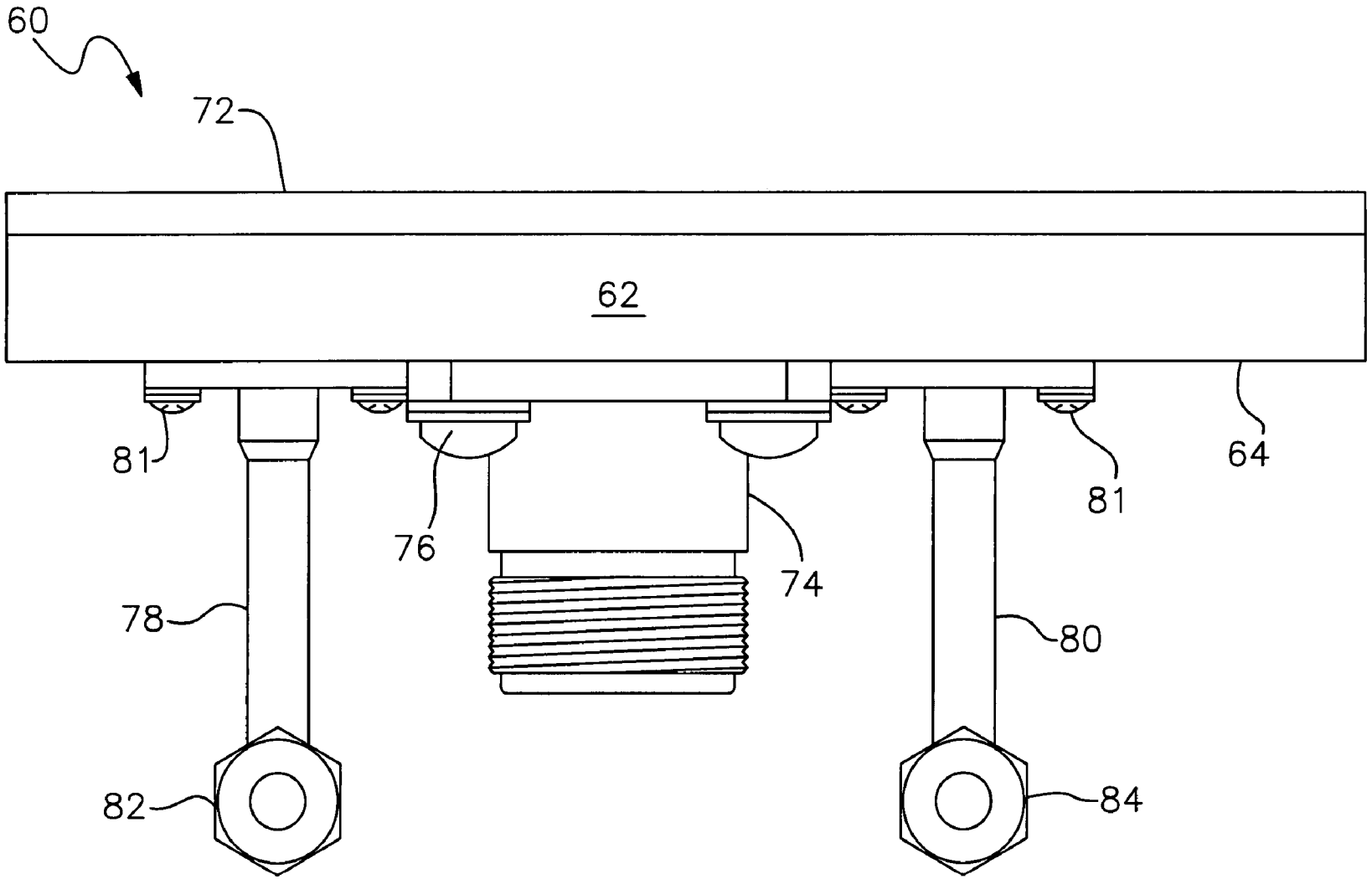
FIG. 3 is a side view of a case and cover for the stripline combiner of FIG. 2.
Figure 4:
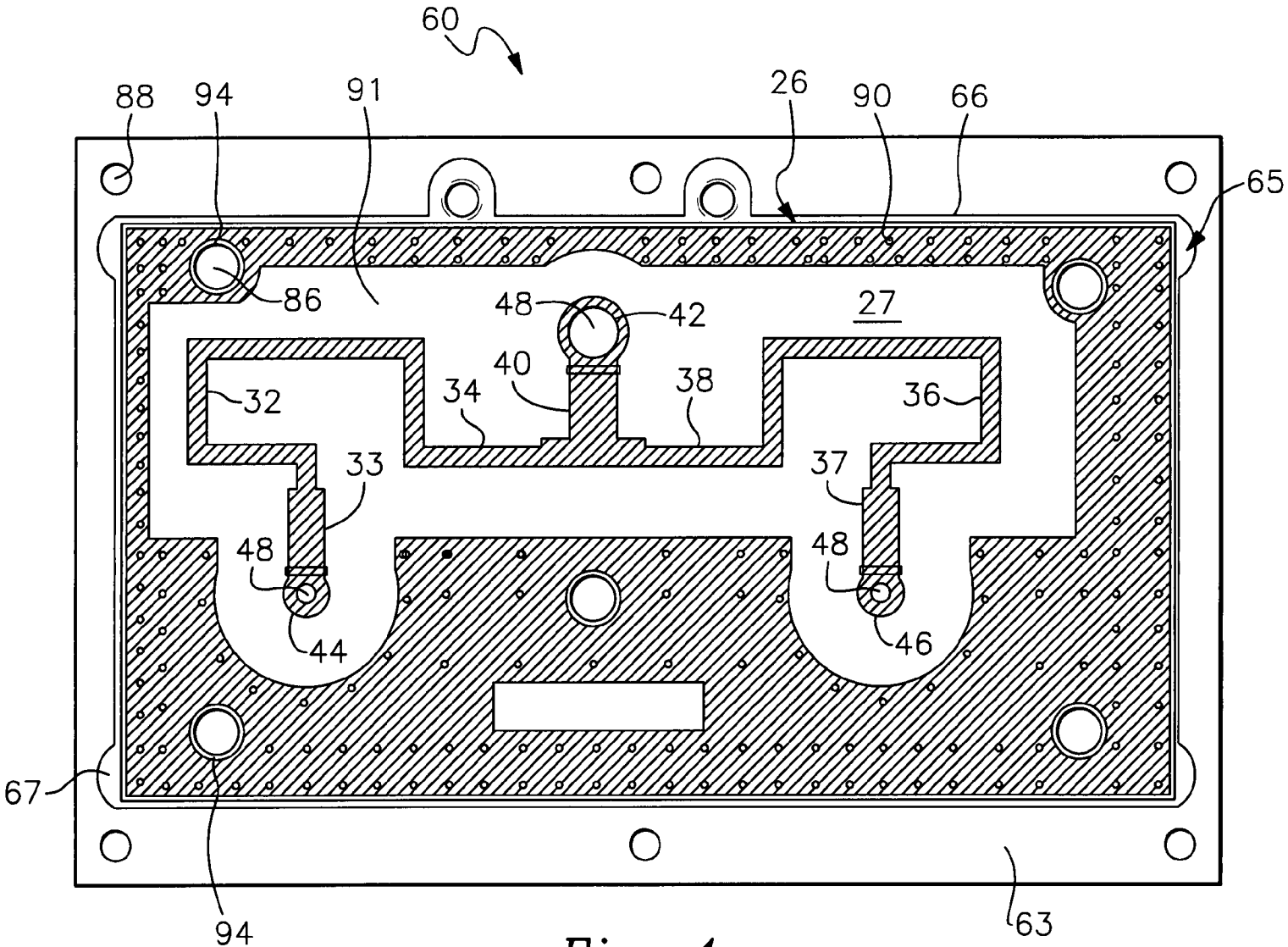
FIG. 4 is a top view of FIG. 3 with the cover and top printed circuit board removed.
Figure 5:
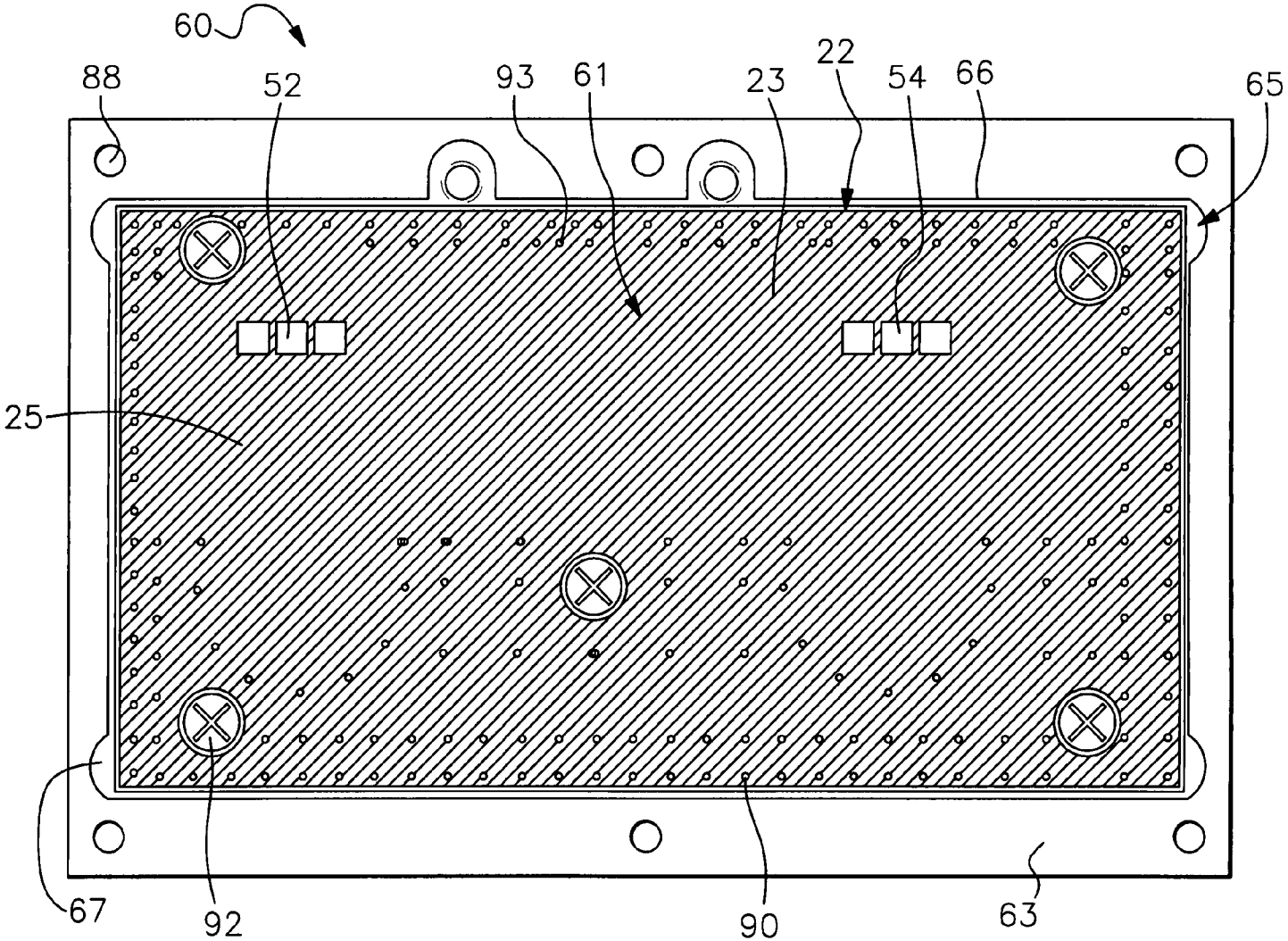
FIG. 5 is a top view of FIG. 3 with the cover removed.

Referring to FIGS. 3–5, tunable amplitude unbalance stripline combiner 61 is shown mounted in a case 62 forming a stripline combiner assembly 60. Case 62 has a cavity 65. Case 62 has a top surface 63 and a bottom surface 64. Cavity 65 defines four walls 66 and a mounting surface 67. Case 62 can be formed from a metal material. Case 62 has threaded printed circuit board mounting holes 86 and threaded cover mounting holes 88. Stripline combiner 61 is mounted in cavity 65.

Stripline combiner 61 is similar to stripline combiner 50 except that a metallized area 87 has been added to top surface 27 of the lower printed circuit board 26. Metallized area 87 defines a non-metallized area 91. Metallized area 87 is electrically connected to metallized area 31 by conductive vias or plated through holes 90. Metallized area 25 is electrically connected to another partial metallized area (not shown) on upper printed circuit board bottom surface 24 by conductive vias or plated through holes 93.

Printed circuit boards 22 and 26 have printed circuit board mounting holes 94. Mounting holes 94 are also plated through holes. Screws 92 extend through mounting holes 94 to secure printed circuit boards 22 and 26 to case 62. Screws 92 also electrically connect metallized area 25 to case 62. The bottom surface metallization 31 of the lower circuit board can be attached to the case mounting surface 67 by a reflowed solder paste if desired.

A coaxial N-type connector 74 is mounted to bottom surface 64 by screws 76. The center pin (not shown) of connector 74 extends into and is soldered in plated through hole 48A. Connector 74 is thereby connected to port 42. The outer case of connector 74 is electrically connected with case 62. A pair of coaxial SMA connectors 82 and 84 are mounted to rigid coaxial cables 78 and 80. Coaxial cables 78 and 80 are mounted to bottom surface 64 by screws 81. The center pin (not shown) of cables 78 and 80 extends into and is soldered in plated through holes 48B and 48C. Cables 78 and 80 are thereby connected to ports 44 and 46. Connector 82 is therefore connected to port 44 and connector 84 is connected to port 46. Case 62 is typically grounded. A metal cover 72 is placed over cavity 65 and is supported by top surface 63. Screws (not shown) are fastened through cover 72 into cover mounting holes 88 to secure cover 72 to case 62.

The non-metallized cavities or voids 52 and 54 change the amplitude unbalance of the combiner. The voids or cavities 52 and 54 can be formed by mechanical methods such as cutting the copper foil with a knife and peeling off the cut copper foil. Before cover 72 is mounted, the stripline combiner is tested for amplitude unbalance using a network analyzer through connectors 74, 82 and 84. If the amplitude unbalance is too high, cavities 52 and 54 are created in metallization 25 in order to adjust or tune the amplitude unbalance to an acceptable level.

If the insertion loss from port 46 to port 42 is higher than the insertion loss from port 44 to port 42, cavities 52 are added over circuit line 32. This increases the impedance of circuit line 32 and increases the insertion loss from port 44 to port 42. At the same time the insertion loss between ports 42 and 46 will decrease. The insertion losses are now more equal. This compensates the amplitude unbalance and reduces the amount of amplitude unbalance. If the amplitude unbalance is still too large, more cavities 52 can be created until the amplitude unbalance is at an acceptable level.

If the insertion loss from port 44 to port 42 is higher than the insertion loss from port 46 to port 42, cavities 54 are added over circuit line 36. This increases the impedance of circuit line 36 and increases the insertion loss from port 46 to port 42. At the same time the insertion loss between ports 42 and 44 will decrease. The insertion losses are now more equal. This compensates the amplitude unbalance and reduces the amount of amplitude unbalance. If the amplitude unbalance is still too large, more cavities 54 can be created until the amplitude unbalance is at an acceptable level.

Stripline combiner 60 is a 2 way combiner since the two input signals are combined into one output signal.

Stripline combiner package 60 can be assembled and adjusted in the following manner:

1. Connectors 74, 82 and 84 are mounted to case 62.
2. Solder paste is placed onto mounting surface 67.
3. Lower printed circuit board 26 is placed onto mounting surface 67 with the connector pins extending into plated through holes 48A, 48B and 48C.
4. Solder paste is placed into holes 48A, 48B and 48C.
5. Case 62 is placed in a reflow oven where the solder paste is melted or reflowed.
6. Upper printed circuit board 22 is placed over lower printed circuit board 26.
7. Screws 92 are placed in holes 94 and 86 to secure the circuit boards to case 62.
8. The amplitude unbalance of the combiner is monitored through connectors 74, 82 and 84 by a network analyzer.
9. A portion of the metallized area 25 is removed using mechanical removal or a laser to form a cavity 52.
10. A portion of the metallized area 25 is removed using mechanical removal or a laser to form a cavity 54.
11. Steps 9 and 10 are repeated until the amplitude unbalance is minimized.
12. A cover 72 is placed over case 62.
13. Screws are fastened into holes 88 to secure cover 72 to case 62.

The present invention has several advantages. The removing of a metallized area to form cavities 52 and 54 allows for a high power stripline combiner to be tuned that has a low amplitude unbalance. The use of the cavities to tune the stripline combiner improves the electrical characteristics of the combiner.

Another advantage of the present invention is that it reduces the amount of defective combiners. Stripline combiners that previously had to be thrown out because the amplitude unbalance was out of specification can now be adjusted so that the amplitude unbalance is within specification. This saves money during combiner manufacturing.

A further advantage of the present invention is that it allows the use of printed circuit boards with less precise line widths and dimensions. Printed circuit boards with less precise line widths can be purchased at a lower cost.

A further advantage of the present invention is that it can be readily implemented in a high volume automated manufacturing operation.

Figure 6:
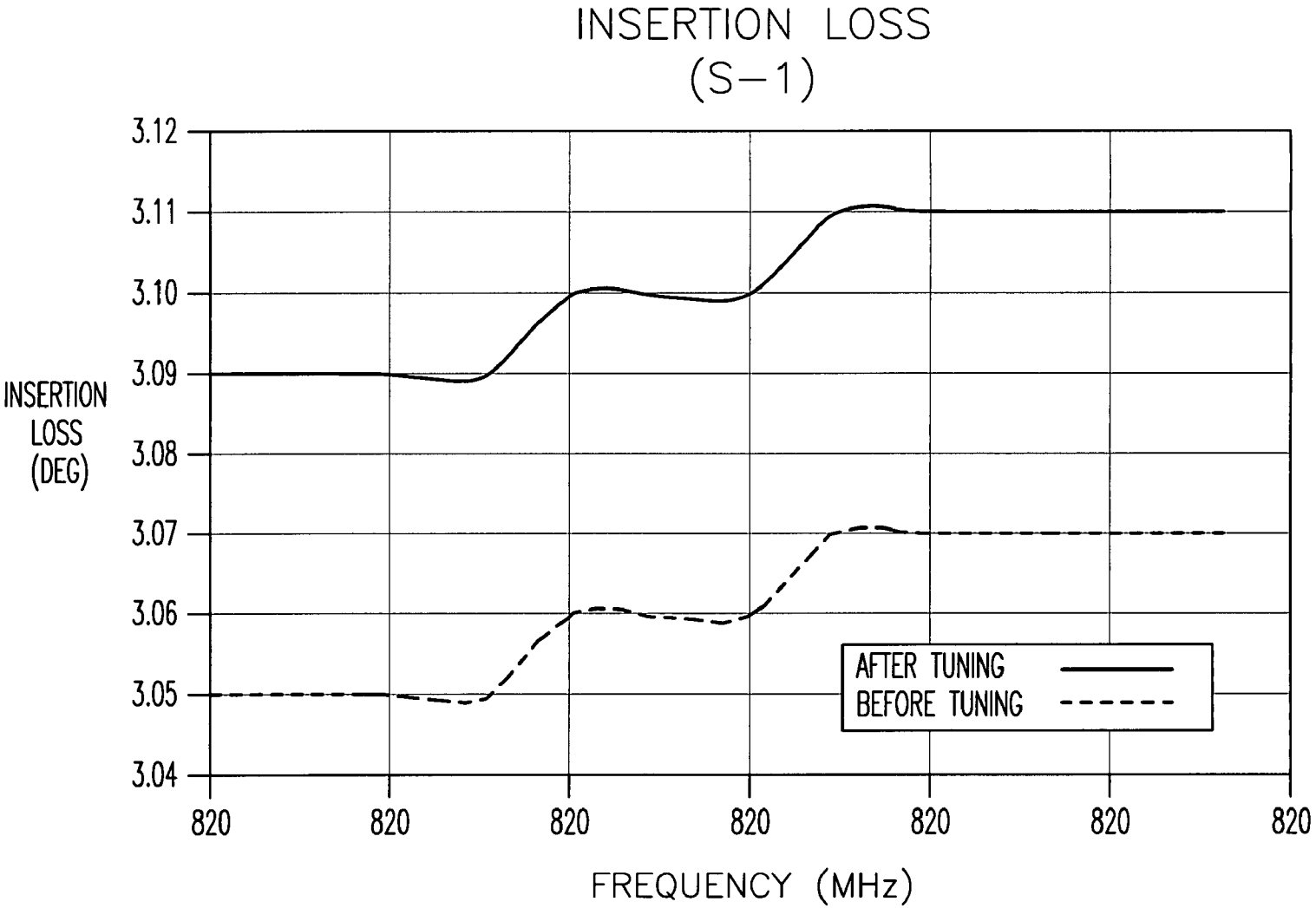
FIG. 6 is a graph showing insertion loss versus frequency for the stripline combiner before and after tuning.

Referring to FIG. 6, a graph showing the insertion loss for stripline combiner 60 between ports 42 and 44 before and after tuning is shown for frequencies from 820 to 940 MHz. The insertion loss was 3.06 dB at 880 MHz before tuning. After metallization 25 was removed to form three cavities 52, the insertion loss increased to 3.10 dB after tuning.

Figure 7:
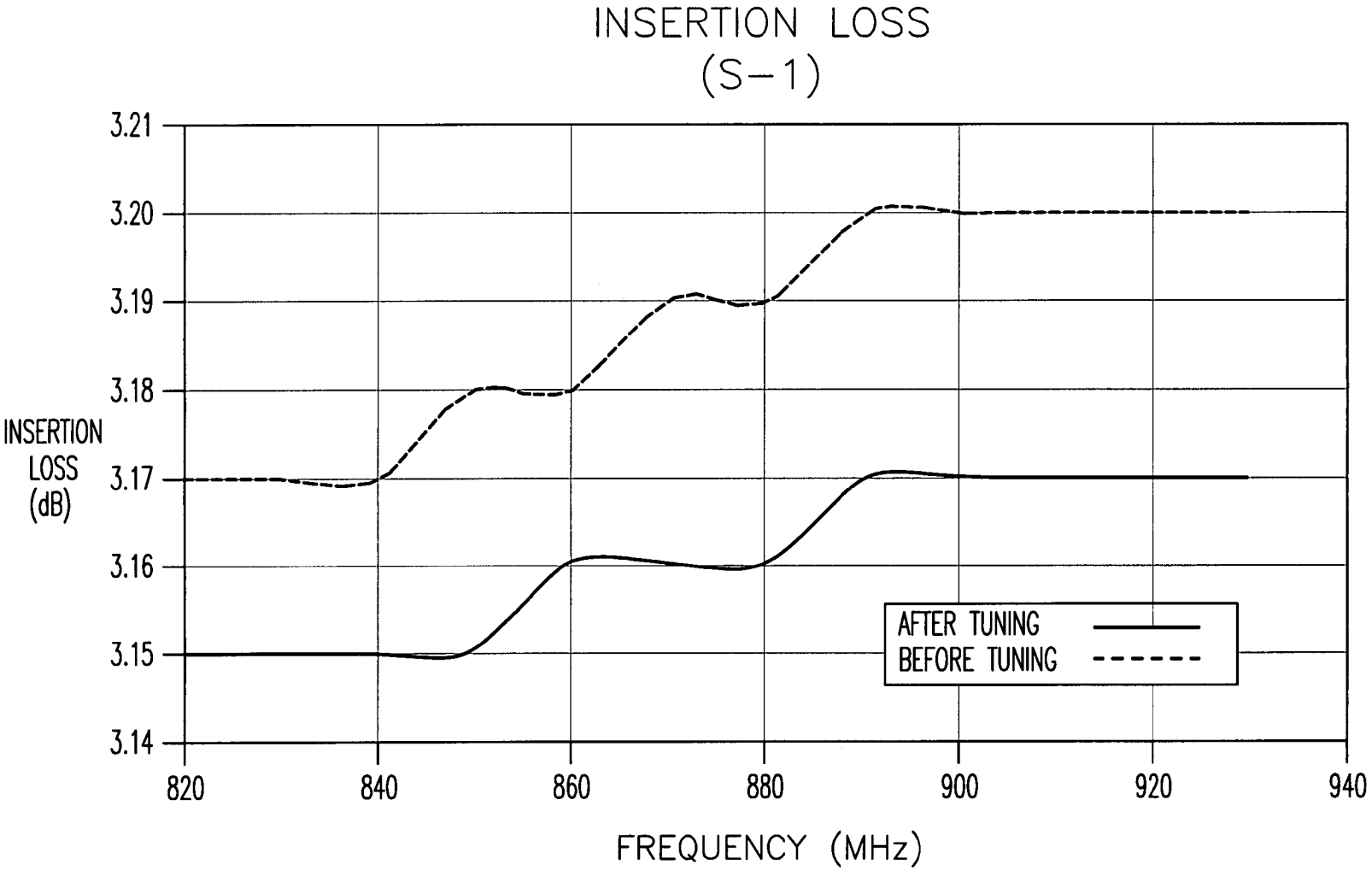
FIG. 7 is a graph showing insertion loss versus frequency for the stripline combiner before and after tuning.

Referring to FIG. 7, a graph showing the insertion loss for stripline combiner 60 between ports 42 and 46 before and after tuning is shown for frequencies from 820 to 940 MHz. The insertion loss was 3.19 dB at 880 MHz before tuning. After metallization 25 was removed to form three cavities 52, the insertion loss decreased to 3.16 dB after tuning.

Figure 8:
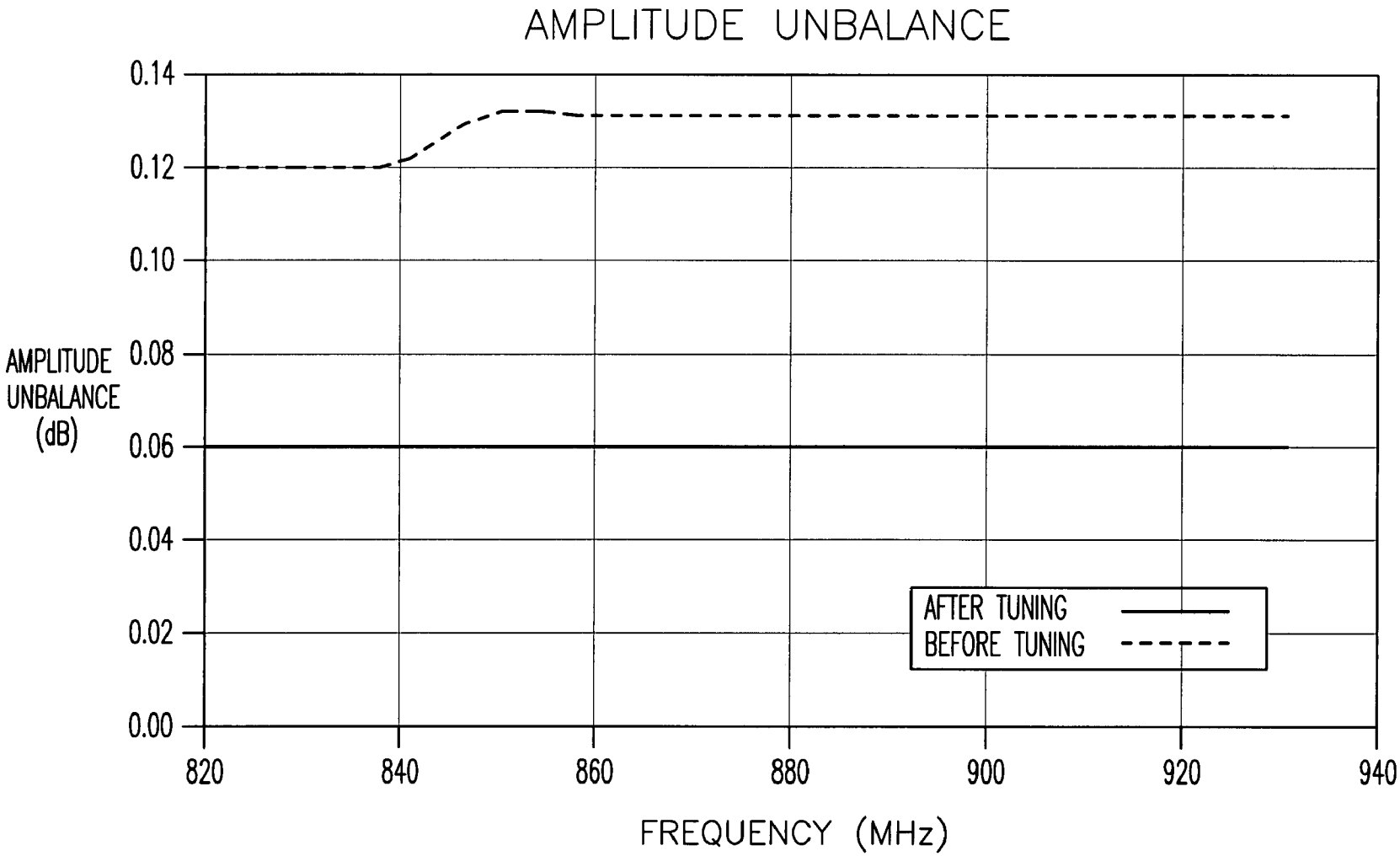
FIG. 8 is a graph showing amplitude unbalance versus frequency for the stripline combiner before and after tuning.

FIG. 8 shows a graph of amplitude unbalance versus frequency before and after tuning for stripline combiner 60. The amplitude unbalance was 0.13 dB at 880 MHz before tuning and 0.06 dB at 880 MHz after tuning. The amplitude unbalance was greatly improved by tuning.

Figure 9:
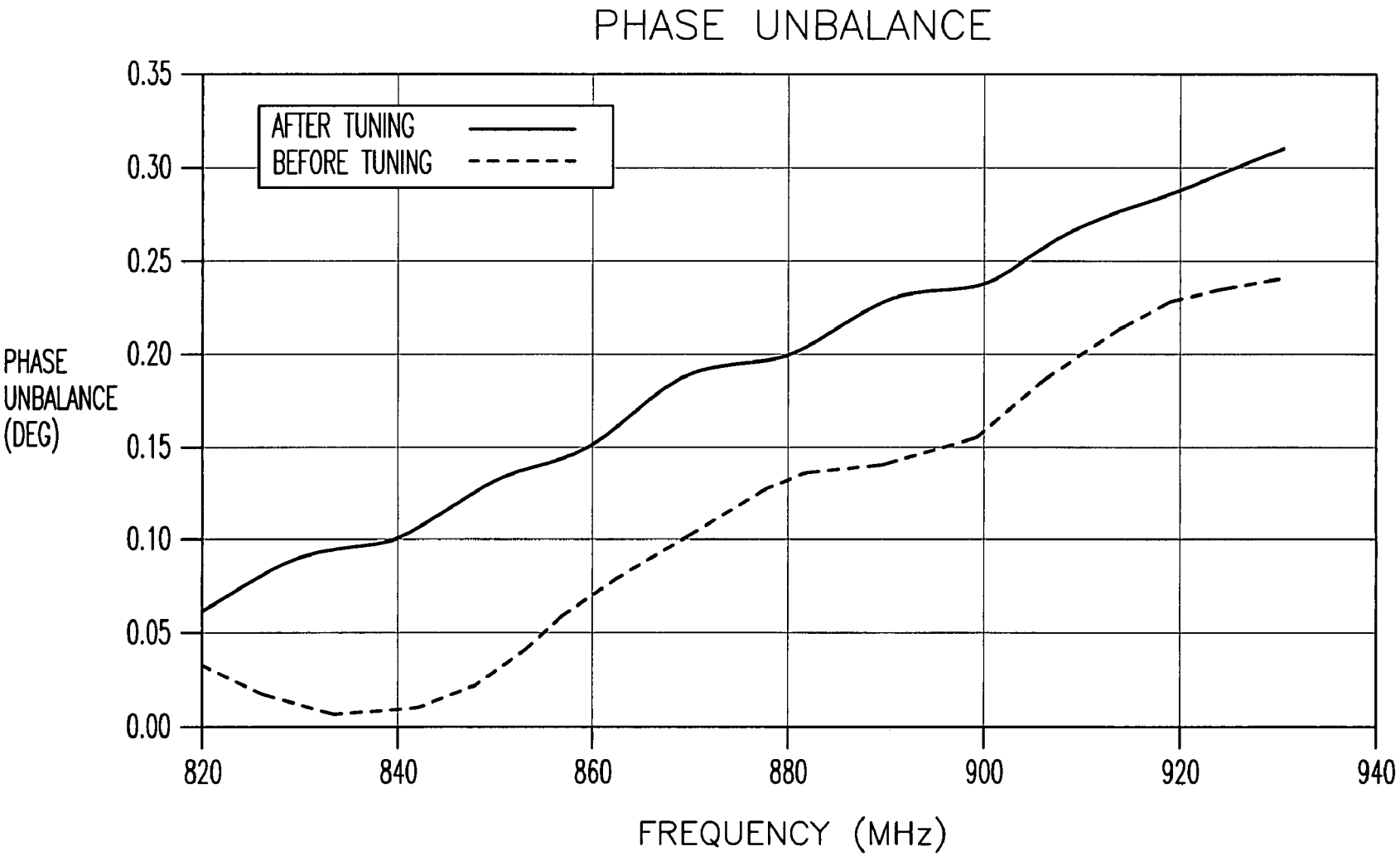
FIG. 9 is a graph showing phase unbalance versus frequency for the stripline combiner before and after tuning.

FIG. 9 is a graph showing phase unbalance versus frequency before and after tuning for stripline combiner 60. The phase unbalance was changed very little by the tuning process.

Figure 10:
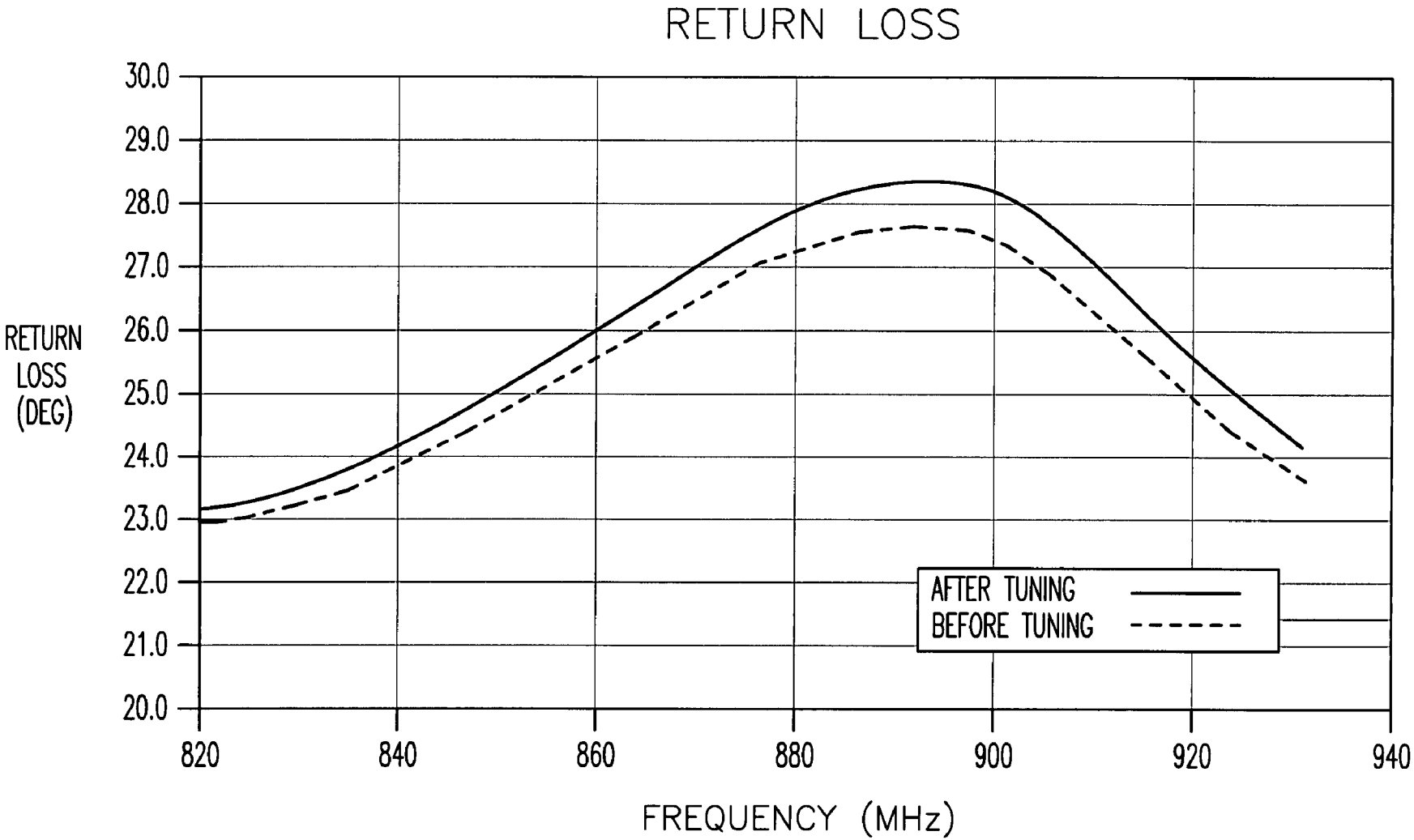
FIG. 10 is a graph showing return loss versus frequency for the stripline combiner before and after tuning.

FIG. 10 shows a graph of return loss versus frequency before and after tuning for stripline combiner 60 at port 42. The return loss was changed very little by the tuning process.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the description. All changes that come within the meaning and range of equivalency of the claims are to be embraced within their scope.

What is claimed is:

1. A combiner comprising:

a) a first printed circuit board having a top surface and a bottom surface;

b) a first metallized area substantially covering the bottom surface of the first printed circuit board;

c) a first circuit line located on the top surface, the first circuit line having a first end and a second end;

d) a second circuit line located on the top surface, the second circuit line having a first end and a second end;

e) the first ends of the first and second circuit lines connected to an output port, the output port being spaced away from an edge of the first printed circuit board;

f) a first input port connected to the first circuit line second end, the first input port being spaced away from the edge of the first printed circuit board;

g) a second input port connected to the second circuit line second end, the second input port being spaced away from the edge of the first printed circuit board;

h) a second printed circuit board having a top surface and a bottom surface, the second printed circuit board mounted over the first printed circuit board;

i) a second metallized area substantially covering the top surface of the second printed board; and j) a plurality of non-metallized voids located in the second metallized area above the first and second circuit lines, the non-metallized voids adapted to change the amplitude unbalance of the combiner.

2. The combiner according to claim 1 wherein, the combiner is mounted within a case.

3. The combiner according to claim 2 wherein, the first and second metallized areas are connected to the case.

4. The combiner according to claim 1 wherein, the first and second circuit lines are c-shaped.

5. The combiner according to claim 2 wherein, a plurality of fasteners hold the first and second printed circuit boards to the case.

6. The combiner according to claim 1 wherein, the first ends of the first and second circuit lines are connected to a common line that is connected to the output port.

7. The combiner according to claim 1 wherein, the input and output ports are plated through holes.

8. A tunable combiner comprising:

a) a case having a cavity, a top surface, a bottom surface, the cavity defining four walls and a mounting surface;

b) a lower printed circuit board having a top surface and a bottom surface, the lower printed circuit board mounted in the cavity on the mounting surface;

c) a first metallized area substantially covering the bottom surface of the first printed circuit board, the first metallized area in electrical contact with the case;

d) a first circuit line located on the top surface and having one end connected to a first input port defined by a first plated through hole and another end connected to an output port defined by a second plated through hole;

e) a second circuit line located on the top surface and having one end connected to a second input port defined by a third plated through hole and another end connected to the output port;

f) an upper printed circuit board having a top surface and a bottom surface, the second printed circuit board mounted over the first printed circuit board in the cavity;

g) a second metallized area substantially covering the top surface of the upper printed circuit board; and h) a first set of non-metallized voids located in the second metallized area juxtaposed to the first circuit line;

i) a second set of non-metallized voids located in the second metallized area juxtaposed to the second circuit line, the voids adapted to change an electrical characteristic of the combiner;

j) a cover mounted over the cavity and attached to the case.

9. The tunable combiner according to claim 8 wherein, the first and second set of non-metallized voids are formed by cutting.

10. The tunable combiner according to claim 8 wherein, the first and second set of non-metallized voids are formed by mechanical removal of the second metallized area.

11. The tunable combiner according to claim 8 wherein, a the first and second circuit lines are c-shaped.

12. The tunable combiner according to claim 8 wherein, the upper and lower printed circuit boards are attached to the case by a plurality of fasteners.

13. The tunable combiner according to claim 8 wherein, the ends of the first and second circuit lines are connected to a common line that is connected to the output port.

14. The tunable combiner according to claim 8 wherein, an unmetallized area covers a portion of the top surface of the lower printed circuit board.

15. The tunable combiner according to claim 8 wherein, a third metallized area covers a portion of the top surface of the lower printed circuit board.

16. The tunable combiner according to claim 8 wherein, at least one connector is mounted to the case, the connector electrically connected to one of the circuit lines.

17. The tunable combiner according to claim 8 wherein, the bottom surface of the upper printed circuit board is insulative.

18. A method of manufacturing a tunable combiner comprising the steps of:

a) providing a lower printed circuit board having a top surface and a bottom surface, a first metallized area substantially covering the bottom surface of the first printed circuit board and a first circuit line located on the top surface, the first circuit line having one end connected to a first input port and another end connected to an output port, a second circuit line located on the top surface, the second circuit line having one end connected to a second input port and another end connected to the output port;

b) providing an upper printed circuit board having a top surface and a bottom surface, the second printed circuit board having a second metallized area substantially covering the top surface of the upper printed circuit board;

c) mounting the upper printed circuit board over the lower printed circuit board;

d) monitoring the amplitude unbalance of the combiner; and e) removing a portion of the second metallized area above the first circuit line to form a first set of voids.

19. The method according to claim 18 further comprising:

a) monitoring the amplitude unbalance of the combiner; and b) removing a portion of the second metallized area above the first and second circuit lines to form a second set of voids until the amplitude unbalance is minimized.

20. The method according to claim 19 further comprising:

a) providing a case having a cavity and a mounting surface;

b) attaching the circuit boards to the mounting surface;

c) attaching the ports to a first, second and third connector mounted to the case; and d) mounting a cover over the cavity to seal the case.

* * * * *